US006306279B1

(12) United States Patent
Kozarek

(10) Patent No.: US 6,306,279 B1
(45) Date of Patent: Oct. 23, 2001

(54) ANODE CATHODE DISTANCE ADJUSTMENT DEVICE

(75) Inventor: Robert L. Kozarek, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/543,972

(22) Filed: Apr. 7, 2000

(51) Int. Cl.[7] ..... C25C 3/20

(52) U.S. Cl. ..... 205/375; 205/378; 205/382; 204/243.1; 204/245; 204/250

(58) Field of Search ..... 204/225, 243.1, 204/245, 250, 297.04; 205/375, 378, 382

(56) References Cited

U.S. PATENT DOCUMENTS 3,616,432 * 10/1971 Day ..... 204/245

* cited by examiner

*Primary Examiner*—Bruce F. Bell
(74) *Attorney, Agent, or Firm*—Glenn E. Klepac

(57) ABSTRACT

A device for adjusting the distance between the anode and the cathode of an electrolytic cell having a compartment, at least one anode partially disposed in a molten metal producing salt bath and a layer of molten metal above a cathode. The device includes a displacement device partially disposed within the layer of molten metal, and an actuator to move the displacement device generally vertically.

30 Claims, 1 Drawing Sheet

ANODE CATHODE DISTANCE ADJUSTMENT DEVICE

FIELD OF THE INVENTION

This invention relates to a device for adjusting the distance between the anode and the cathode of a Hall-Heroult electrolytic cell and, more specifically, to a device which includes a displacement device which cooperates with a sump to raise or lower the level of the molten metal thereby changing the anode-cathode distance.

BACKGROUND OF THE INVENTION

A number of materials including metals such as aluminum, lead, magnesium, zinc, zirconium, titanium and silicon, for example, can be produced by electrolytic processes. Although individual processes may vary in some respects from one to another, each employs the use of an electrode which must operate in a highly corrosive environment.

An example of such a process for the production of metal is the well-known Hall-Heroult process (hereinafter referred to as the Hall process) for producing aluminum in which alumina dissolved in a molten fluoride salt bath is electrolyzed at temperatures from 900° C. to 1000° C. Typically the Hall process includes compartment which contains at least one anode disposed in the salt bath above a lower surface which acts as a cathode. There is an optimal gap between the bottom of the anode and cathode for producing aluminum. This gap is called the anode-cathode distance or "ACD." The optimal ACD depends on a variety of factors such as the size and shape of the bottom of the anode, voltage between the anode and cathode, and material used to make the anode. Typically, each of these factors remains constant. The ACD changes, however, because as the process reduces alumina to produce molten aluminum, a layer of molten aluminum collects between the lower surface and the salt bath. Because aluminum is conductive, the upper surface of the layer of molten aluminum acts as the cathode. Thus, as process creates aluminum, the elevation of the cathode increases and the ACD is reduced. The ACD also changes when molten aluminum is removed from the compartment for casting.

In the process as generally practiced today, carbon is used as the anode. In a typical operation of a Hall cell using carbon as the electrode, it is desirable that the carbon be in a block form. The carbon block is consumed during the electrolytic process and a large block or mass minimizes the frequency with which electrodes must be replaced. During the process, the carbon is oxidized to primarily form $CO_2$ which is given off as a gas. The oxidation occurs mainly along the bottom surface of the anode, adjacent to the cathode. As the block is oxidized, the distance between the anode and the cathode increases. To adjust to anode cathode distance, the anode was typically mounted on a rod which could be moved vertically. This vertical adjustment accounted for both the rise in the elevation of the cathode and the reduction of the anode. Because the rise in elevation of the molten aluminum is typically not as great as the reduction in the size of the anode, the anode was usually being slowly lowered into the salt bath.

Despite the common usage of carbon as electrode material in practicing the Hall process, there are a number of disadvantages to its use. Carbon is consumed in relatively large quantities in the Hall process, approximately 420 to 550 kg per ton of aluminum produced. If prebaked electrodes are used, it may be seen that a relatively large facility is needed to produce sufficient electrodes to operate an aluminum smelter. Furthermore, to produce the purity of aluminum required to satisfy primary aluminum standards, the electrode must be relatively pure carbon, and availability and cost of raw materials to make the carbon are of increasing concern to aluminum producers.

Because of the disadvantages inherent in the use of carbon as an electrode, there has been a continuing search for inert or nonconsumable materials that can operate as an electrode with a reasonable degree of electrochemical efficiency and withstand the high temperature and extremely corrosive environment of the molten salt bath. One such material is a cermet material. Some cermet inert electrode materials are disclosed in U.S. Pat. Nos. 4,374,050, 4,374,761, 4,399,008, 4,455,211, 4,582,585, 4,584,172, 4,620,905, 5,794,112 and 5,865,980 and U.S. application Ser. No. 09/241,518, now U.S. Pat. No. 6,126,799, which are assigned to the assignee of this Application and which are incorporated by reference.

Cermet bodies are subject to cracking and damage. Therefore it is preferable to minimize moving the cermet anode in the salt bath. Because the cermet is not consumed, there is no longer a need to constantly lower the anode into the salt bath. The ACD still needs to be adjusted, however, due to the rising elevation of the molten aluminum which acts as the cathode.

Care must be taken, however, to avoid having a device in the molten aluminum and salt bath which creates a reservoir for impurities. When using a carbon anode, the compartment in which the molten aluminum forms is, generally speaking, a flat bottomed trough. This compartment may be maintained at an even temperature which is sufficiently hot enough to keep impurities from precipitating. If the compartment did not have this shape, pockets of cooler molten aluminum could form. Alumina and other impurities may precipitate in the cooler regions of asymmetric cell. This precipitate material, generally called "muck," is not desirable and must be removed from the molten aluminum.

There is, therefore, a need for a device to adjust the ACD which does not require moving the anode.

There is a further need for a device to adjust the ACD which provides a means for eliminating muck from the molten aluminum.

SUMMARY OF THE INVENTION

These needs, and others, are addressed by the invention which provides a device for adjusting anode-cathode distance using a displacement device which cooperates with a sump to raise or lower the level of the molten metal thereby changing the anode-cathode distance.

The anode members may be made of a cermet material having between about 70% and 90% nickel ferrite by weight and, more preferably between about 83% and 85% nickel ferrite by weight. The balance of the cermet material may be copper, silver, and/or a noble metal. The anodes are disposed at a fixed position in a compartment containing a molten metal producing salt bath. A portion of the bottom of the compartment is a cathode. Through an electrolytic process, aluminum is produced when alumina is introduced into the salt bath. Molten aluminum collects above the cathode and, because aluminum is conductive, the upper surface of the aluminum acts as a cathode. As the elevation of the molten aluminum increases, the distance between the fixed anode and the cathode decreases.

At the beginning of the electrolytic process, the ACD is not optimal. As aluminum is produced, the elevation of the cathode increases and the ACD becomes more optimal. When a sufficient quantity of aluminum is produced and the elevation of the cathode rises too much, the ACD becomes less optimal. The present invention provides a device for controlling the ACD so that it remains near optimal.

The present invention provides a displacement device which is partially disposed in the molten aluminum. The displacement device occupies a sufficient volume so that raising or lowering the displacement device will cause the elevation of the upper surface of the molten aluminum to lower or rise significantly. The compartment may include a sump to contain additional molten aluminum to affect the change in the cathode elevation.

It is an object of this invention to provide a device for adjusting the distance between the anode and the cathode of a Hall-Heroult electrolytic cell having a compartment, at least one anode partially disposed in a molten fluoride salt bath and above a layer of molten aluminum, a cathode being integral to the compartment and in electrical communication with the layer of aluminum, a displacement device partially disposed within the layer of molten aluminum, and an actuator to move the displacement device generally vertically.

BRIEF DESCRIPTION OF THE DRAWINGS

A full understanding of the invention can be gained from the following description of a preferred embodiment when read in conjunction with the accompanying drawings in which.

DESCRIPTION OF PREFERRED EMBODIMENTS

Figure 1:
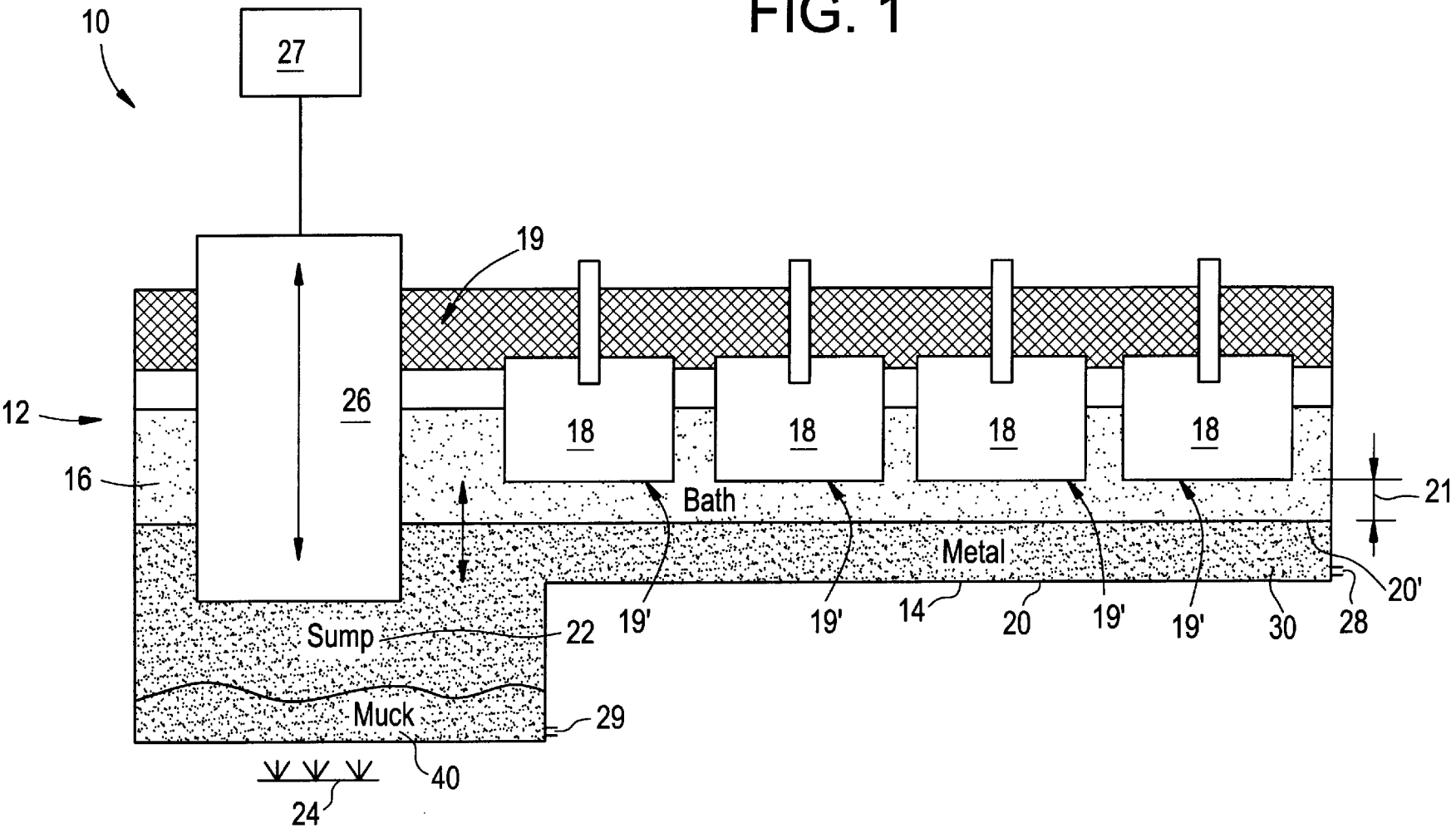
FIG. 1 is a schematic cross sectional view of a Hall cell according to an embodiment of the present invention.

For convenience, a preferred embodiment of this invention will be described with reference to an electrode assembly for producing aluminum by an electrolytic process. It is to be understood, however, that the scope of this invention is intended to include its use in producing other metals by electrolysis as well.

As shown in FIG. 1, the Hall cell 10 includes compartment 12 having a lower surface 14. A molten fluoride salt bath 16 is contained in the compartment 12. At least one fixed anode 18 is disposed partially within the salt bath 16. A fixed anode 18 is one that is generally maintained in one position while the electrolytic process is occurring. The fixed anode 18 may be moved for repair and replacement. The lower surface 14 acts as a cathode 20. The compartment lower surface 14 may include a sump portion 22. A heater 24 may be disposed below the sump portion 22. A movable displacement device 26 is disposed in the salt bath 16 within the sump portion 22. Both compartment 12 and the sump portion 22 may include a tap 28 and 29, respectively, located adjacent to the lower surfaces of the compartment 12 or sump portion 22. Each tap 28, 29 is structured to allow molten aluminum 30 to be removed from the cell 10. Fixed insulation 31 maybe placed above the anode 18. The insulation 31 may be made from any suitable material such as sintered blocks of cryolite and alumina.

The displacement device 26 is preferably an elongated rectangular box having a vertical axis. The displacement device 26 may be made of any material which does not react with the molten bath or alumina, such as boron, boron coated graphite, carbon or $Al_2O_3$. The displacement device may, however, have any shape. The displacement device 26 is sized to have a sufficient volume so that it may effectively displace enough molten aluminum 30 (described below) to change the anode-cathode distance within compartment 12. The displacement device 26 may be moved vertically by any known means, such as an actuator or a worm drive 27.

The anode 18 is preferably made of a cermet material having between about 70% and 90% nickel ferrite by weight and, more preferably between about 83% and 85% nickel ferrite by weight. The balance of the cermet material may be copper, silver, and/or a noble metal. Materials suitable for construction an inert anode may be found in U.S. Pat. Nos. 4,374,050, 4,374,761, 4,399,008, 4,455,211, 4,582,585, 4,584,172, 4,620,905, 5,794,112 and 5,865,980 and U.S. application Ser. No. 09/241,518, which are assigned to the assignee of this Application and which are incorporated by reference. The anode 18 has a lower surface 19. The anode-cathode distance, or ACD, 21 is measured between the anode lower surface 19 and the cathode 20, 20' (described below).

In operation, the Hall cell 10 creates a layer of molten aluminum 30 between the salt bath 16 and the cathode 20. The molten aluminum 30 also fills the sump portion 22. The displacement device 26 is partially disposed within the molten aluminum 30. Because aluminum is conductive, the upper surface 32 of the aluminum layer 30 acts as the cathode 20'. As aluminum continues to be produced, the depth of the molten aluminum 30 increases causing the upper surface 32, and therefore the cathode 20', to increase in elevation and decrease the ACD 21.

To adjust the ACD 21, the displacement device 26 may be raised or lowered. Because the displacement device 26 is partially disposed in the molten aluminum 30, raising S the displacement device 26 will cause the elevation of molten aluminum upper surface 32 to decrease. Conversely, lowering the displacement device 26 will cause the elevation of molten aluminum upper surface 32 to increase. Thus, the distance between the cathode 20', which is the upper surface 32 of the molten aluminum 30, and the fixed anodes 18 maybe adjusted by raising and lowering the displacement device 26. Typically, the displacement device 26 will be slowly raised as the process creates aluminum 30. When a sufficient quantity of molten aluminum 30 is in cell 10, however, it may be drained through the tap 28. When molten aluminum 30 is being drained, the displacement device 22 is lowered so that the elevation of the upper surface 32, and therefore the cathode 20', may be maintained at a constant distance from the anode 18.

The cathode 20 is always spaced apart from the anode 18. An optimum ACD 21 may be determined for a particular cell 10 geometry. Typically the ACD ranges from between about 1.0 inch to 2.0 inches, and is more preferably about 1.25 inches. The present invention may be used to maintain the optimum ACD 21. As the ACD 21 is constantly changing, the present device may be used in conjunction with a traditional resistance control system to maintain this optimum ACD 21.

The worm drive 27 may be structured to provide vertical movement of the displacement device 26 in increments of about 0.001 inches. The worm drive 27 may be coupled to a control system which includes sensors for the cell voltage and amperage. As is known in the art, a pseudo-resistance is computed from voltage and amperage in cell lo according to the expression $R=(V_{cell-Vexit})/I_{cell}$, where $V_{cell}$ is the voltage in the cell, $V_{ext}$ is the extrapolated voltage at zero current, and $I_{cell}$ is the cell current. ACD 21 is adjusted by comparing the pseudo-resistance to a target value. When the pseudo-resistance is below the target value, ACD 21 is increased. When the pseudo-resistance is above the target value, ACD 21 is decreased.

Because the sump portion 22 is spaced from the anode 18 where electrolysis is taking place and heat is being created, the aluminum 30 in the sump portion 22 will be cooler than other areas in the salt bath 16. Because of the lower temperature of the aluminum 30 in the sump portion 22, muck 40 will precipitate and accumulate in the sump portion 22. Muck 40 may be removed from cell 10 through the tap 29 or by using a mechanical device, such as a clam shell (not shown), for dredging the sump portion 22. In addition, a heater 24 may be used to increase the temperature of the molten aluminum 30 in the sump portion 22 thereby increasing the solubility limit of the muck 40 so that the muck 40 may be redissolved in the molten aluminum 30.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. In an electrolytic cell comprising a cathode in electrical communication with a layer of molten metal, a molten metal production salt bath positioned above the layer of molten metal, at least one anode partially disposed in said salt bath, and a compartment including a lower surface below said anode and a sump portion extending below said lower surface, the improvement comprising a displacement device partially disposed within said sump portion, said displacement device being movable within said layer of a molten metal to control elevation of the molten metal and the anode-cathode distance.

2. The device of claim 1 wherein the displacement device is movable vertically and the elevation of said upper surface of the layer of molten metal is responsive the vertical motion of said displacement device.

3. The device of claim 2 wherein said means to move said displacement device vertically is a worm drive.

4. The device of claim 2 wherein said displacement device comprises a vertically oriented elongated rectangular box made from boron, boron coated graphite, carbon or $Al_2O_3$.

5. The device of claim 1 wherein said anode is fixed relative to said electrolytic cell compartment.

6. The device of claim 5 wherein said anode is an inert anode.

7. The device of claim 1 wherein said molten metal is aluminum.

8. The device of claim 1 wherein the displacement device is movable vertically and the elevation of said upper surface of the layer of molten metal is responsive the vertical motion of said displacement device.

9. The device of claim 8 wherein said displacement device comprises a vertically oriented elongated rectangular box made from boron, boron coated graphite, carbon or $Al_2O_3$.

10. An electrolytic cell comprising:

a compartment having a lower surface and containing a molten salt bath and a layer of molten metal having an upper surface;

a sump portion extending below said lower surface and containing molten metal;

at least one anode partially disposed in said molten salt bath;

a cathode in electrical communication with said layer of molten metal; and a device for adjusting the distance between the anode and the upper surface of said layer of molten metal comprising:

a displacement device partially disposed in said sump portion and within said layer of molten metal; and an actuator connected to the displacement device to adjust the vertical height of the displacement device to thereby control the elevation of the upper surface of the molten metal.

11. The electrolytic cell of claim 10 further comprising a means to remove muck from said sump portion.

12. The electrolytic cell of claim 11 wherein said means to remove muck from said sump portion includes a heater disposed below said sump portion.

13. The electrolytic cell of claim 12 wherein said means to remove muck from said sump portion includes a tap located adjacent to a lower surface of said sump portion.

14. The electrolytic cell of claim 13 wherein said means to remove muck from said sump portion further includes a heater disposed below said sump portion.

15. The electrolytic cell of claim 10 wherein said actuator comprises a worm drive.

16. The device of claim 10 wherein said anode is fixed relative to said electrolytic cell compartment.

17. The device of claim 16 wherein said anode is an inert anode.

18. The device of claim 10 wherein said molten metal is aluminum.

19. A method of controlling the distance between an anode and a cathode of an electrolytic cell having a compartment including a lower surface and a sump portion extending below said lower surface at least one anode partially disposed in a molten metal production salt bath and positioned above a layer of molten metal whereby the upper surface of the molten metal acts as the upper surface of the cathode, an anode-cathode distance defined as the distance between the upper surface of the cathode and the lower surface of the anode, a displacement device at least partially disposed within said sump portion of molten metal, said method comprising:

producing molten metal in said compartment; and controlling the elevation of said molten metal in said compartment by moving said displacement device.

20. The method of claim 19 further including the steps of:

determining the optimal anode-cathode distance;

adjusting said displacement device to maintain the anode-cathode distance within at about the optimal anode-cathode distance.

21. The method of claim 19 wherein said displacement device is moved substantially vertically.

22. The method of claim 19 wherein said anode is fixed relative to said electrolytic cell compartment.

23. The method of claim 22 wherein said anode is an inert anode.

24. The method of claim 19 wherein said molten metal is aluminum.

25. A method of producing metal in an electrolytic cell having a compartment including a lower surface and a sump portion extending below said lower surface at least one anode partially disposed in a molten metal production salt bath and positioned above a layer of molten metal, a cathode in electrical communication with said layer of molten metal whereby the upper surface of the molten metal acts as the upper surface of the cathode, an anode-cathode distance defined as the distance between the upper surface of the cathode and the lower surface of the anode, a displacement device partially disposed within said sump portion and within said layer of molten metal, said method comprising:

producing molten metal in said compartment; and controlling the elevation of said molten metal in said compartment by moving said displacement device in said sump portion.

26. The method of claim 25 further including the steps of:

determining the optimal anode-cathode distance;

adjusting said displacement device to maintain the anode-cathode distance at about the optimal anode-cathode distance.

27. The method of claim 25 wherein said displacement device is moved substantially vertically.

28. The method of claim 25 wherein said anode is fixed relative to said electrolytic cell compartment.

29. The method of claim 28 wherein said anode is an inert anode.

30. The method of claim 25 wherein said molten metal is aluminum.

* * * * *